US010952491B2

(12) United States Patent
Smeyers

(10) Patent No.: US 10,952,491 B2
(45) Date of Patent: Mar. 23, 2021

(54) FOOTWEAR ITEM COMPRISING A DEVICE FOR STORING INFORMATION OR AN OBJECT

(71) Applicant: GLOBAL SECURE SA, Strassen (LU)

(72) Inventor: René Smeyers, Geraardsbergen (BE)

(73) Assignee: GLOBAL SECURE SA, Strassen (LU)

( * ) Notice: Subject to any disclaimer, the term of this patent is extended or adjusted under 35 U.S.C. 154(b) by 190 days.

(21) Appl. No.: 16/306,387

(22) PCT Filed: Sep. 8, 2016

(86) PCT No.: PCT/EP2016/071217
§ 371 (c)(1),
(2) Date: Nov. 30, 2018

(87) PCT Pub. No.: WO2017/207074
PCT Pub. Date: Dec. 7, 2017

(65) Prior Publication Data

US 2020/0323302 A1 Oct. 15, 2020

(30) Foreign Application Priority Data

May 30, 2016 (LU) ..... 93087

(51) Int. Cl.
*A43B 3/00* (2006.01)
*A43B 13/14* (2006.01)

(52) U.S. Cl.
CPC ..... *A43B 3/0031* (2013.01); *A43B 13/14* (2013.01)

(58) Field of Classification Search
CPC ..... A43B 3/0031; A43B 13/14
See application file for complete search history.

(56) References Cited

U.S. PATENT DOCUMENTS 1,022,106 A * 4/1912 Murphy ..... A43C 13/04 36/67 C
1,751,069 A * 3/1930 Blain ..... A43B 3/0031 36/1
2,904,901 A * 9/1959 Goldstein ..... A43B 21/00 36/1

(Continued)

OTHER PUBLICATIONS

International Search Report issued in connection with PCT/EP2016/071217 dated Jan. 31, 2017.

*Primary Examiner* — Ted Kavanaugh
(74) *Attorney, Agent, or Firm* — Steven M. Shape; Dennemeyer & Associates, LLC

(57) ABSTRACT

The invention relates to a footwear item comprising a device for storing information or an object. The footwear item comprises a sole (1) including a front part (201) and a rear part (101), with a hole (2) being provided in the sole (1) that opens onto the front part (200) or the rear part (100) of the footwear item (0). The footwear item (0) also comprises: a casing (3, 4) inserted into the hole (2) in the sole (1), said casing (3, 4) comprising a duct (3) for storing information or an object, said duct (3) comprising an opening (153) and a closed part (353); a means for anchoring the duct (3) in the hole (2) in the sole (1), designed to secure the duct (3) to the sole (1), allowing same to be secured to one another permanently; and a cover (4) hermetically sealing the opening (153) in the duct (3) such that the casing (3, 4) is leak-tight.

15 Claims, 14 Drawing Sheets

(56) References Cited

U.S. PATENT DOCUMENTS

| | | | | | |
|---|---|---|---|---|---|
| 3,785,646 | A * | 1/1974 | Ruskin | A43B 13/206 | 482/105 |
| 3,842,520 | A * | 10/1974 | Heptig | A43B 13/24 | 36/74 |
| 4,402,641 | A * | 9/1983 | Arff | F16B 19/004 | 24/297 |
| 4,724,628 | A * | 2/1988 | Schreiner | A43B 3/0078 | 2/245 |
| 5,524,365 | A * | 6/1996 | Goldenberg | A43B 3/24 | 36/36 C |
| 6,050,007 | A | 4/2000 | Angelieri | | |
| 6,289,612 | B1 * | 9/2001 | Kent | A43B 3/00 | 36/132 |
| 6,360,779 | B1 * | 3/2002 | Wagner | F16L 55/105 | 138/89 |
| 8,745,897 | B2 * | 6/2014 | Wojnar | A43C 15/061 | 36/59 R |
| 9,090,318 | B2 * | 7/2015 | Koelling | A63C 17/017 | |
| 9,655,408 | B1 * | 5/2017 | Marti | A43B 3/0078 | |
| 2003/0126769 | A1 * | 7/2003 | Chen | A43B 3/001 | 36/137 |
| 2014/0283416 | A1 | 9/2014 | Yamada | | |
| 2015/0164176 | A1 | 6/2015 | Shuman | | |

* cited by examiner

FOOTWEAR ITEM COMPRISING A DEVICE FOR STORING INFORMATION OR AN OBJECT

CROSS-REFERENCE TO RELATED APPLICATIONS

This is a 35 U.S.C. 371 National Stage Patent Application of International Application No. PCT/EP2016/071217, filed Sep. 8, 2016, which claims priority to Luxembourg application no. 93087, filed May 30, 2016, each of which is hereby incorporated by reference in its entirety.

TECHNICAL FIELD

In accordance with a first aspect, the present invention relates to a footwear item including a device for storing information or an object. In accordance with a second aspect, the invention proposes a footwear item capable of receiving a storage device. In accordance with a third aspect, the invention proposes a casing comprising a device for storing information or an object suitable for insertion in a footwear item. In accordance with a fourth aspect, the invention proposes a method for producing a footwear item. A "footwear item" shall be understood here to mean any style of footwear item (child's, women's, men's), of espadrille, of sandal, of boot, or bare feet.

PRIOR ART

According to the prior art, there exist footwear items with a housing for a storage module accessible from outside.

Publication WO-A1-9311681 describes a sports footwear item comprising a sole and a receptacle incorporated in the sole and intended to receive and releasably hold a plug-in module in a rail, the plug-in module including a battery and electrical circuit elements.

Publication US-A1-2007260421 describes another example of a footwear item in which a housing element is provided for an electronic module and is accessible from outside the structure of the footwear item, said footwear item also comprising a casing with a removable cover element.

These structures are generally formed by different devices that can be housed in the footwear item and that can be easily fixed to the sole.

However, one criticism of these known footwear items with storage device could be considered the fact that they are not designed to prevent dirt or water from deteriorating the casing, and that they are heavy, bulky and unreliable. For the storage structures, the assembly and disassembly of systems of this kind requires a lot of time. In addition, problems result also in respect of their implementation, because these devices for storing an object are unreliable and are not resistant to the weather, to frost, or to elevated temperatures. In particular, over time, these storage devices can easily detach from the footwear item (in the case of frost or elevated temperatures) or are no longer leak-tight.

Difficulties in respect of implementation manifest in particular for certain storage devices which are not securely fixed to the footwear item or which are not completely leak-tight, which poses certain problems.

In addition, these known devices for storing information or an object in footwear items are relatively easy to open, even for a child.

SUMMARY OF THE INVENTION

It is therefore clear that there is a need for a system which, to a large extent, makes it possible to overcome the disadvantages encountered in the prior art. One object of the invention is to provide a footwear item comprising a device for storing information or an object. The invention has a number of objectives:

- assist individuals in danger or incapable of communicating crucial information at a specific moment (young children, handicapped individuals, individuals who have been involved in an accident resulting in memory loss, unidentified persons)
- allow two adults to communicate items and information when the person wearing the footwear items is unable to assist them in this process (young children, handicapped individuals)
- protect against potential attacks (deterrent)

The presence of the device for storing information or an object makes it possible to reinforce a feeling of safety for the individual wearing the footwear item.

It is possible to file/store in this device an important object or a paper document containing information (indispensable survival list, identification information), such as name
date of birth
personal address
blood group
allergy to medicaments and foods
other medical information
contact name and person (family)
doctor's name
hospital information,
other information: tattoos, glasses, specific identifying marks It is also possible to file/store an important object in this device, such as medicaments, a microchip, a GPS tracker, money, a USB stick, etc.

The problem to be solved is that of overcoming the disadvantages of the prior art mentioned above and finding a footwear item that includes a device for storing information or an object, which device is fixedly connected to the footwear item and is completely leak-tight.

Consequently, one object of the present invention is to provide a footwear item including a discrete device for storing information or an object, which device also offers a high ease of use whilst being very reliable and robust.

Another object of the present invention is to propose a footwear item including a completely leak-tight and robust device for storing information or an object, which device is also easy to open for an adult, but relatively difficult to open for a child.

The present invention makes it possible to simplify the manipulation of the footwear item so as to facilitate the positioning of the device for storing information or an object and so as to easily and fixedly anchor said device in the footwear item whilst also making said device leak-tight and fixed permanently to the footwear item. Another objective of the invention is to facilitate access to the information or the object placed in the storage device.

More particularly, to this end, in accordance with the invention, this objective is achieved by the fact that the footwear item with device for storing information or an object of the aforementioned type comprises a sole, the sole including a front part and a rear part, wherein the sole includes a hole which opens out into the front part or the rear part of the footwear item, and wherein the footwear item comprises a casing inserted into the hole in the sole, characterised in that the casing comprises a duct allowing the storage of information or an object, the duct including an opening and a closed part, a means for anchoring the duct in the hole in the sole, said anchoring means being suitable for fixing the duct to the sole and making it possible to secure the duct to the sole permanently, and a cover hermetically closing the opening of the duct so as to make the casing leak-tight.

This makes it possible to prevent dirt or water from deteriorating the casing, the cover closing the mouth of the hole in a leak-tight manner whilst said device is easy to open for an adult, but is relatively difficult to open for a child.

In addition, this makes it possible to achieve a robust and leak-tight fixing between the sole and the casing, the anchoring means being designed to make it possible to secure the duct to the sole permanently. The fixing of the cover on the duct results in the creation of a resistance which makes it difficult for a child to remove the cover. This closure system makes it possible to obtain a leak-tight fixing, which is easy to open for an adult, but relatively difficult to open for a child.

In one embodiment of the invention, the anchoring means is preferably integrated in the duct.

In one embodiment of the invention, the anchoring means includes bumps on the outer face of the duct so as to make it possible to anchor the duct in the hole in the sole so as to secure said parts permanently, the bumps being provided in a half-moon shape, open towards the opening of the duct and solid towards the closed part of the duct so as to facilitate the insertion of the duct into the hole and prevent said duct from then being removed.

In another embodiment of the invention, the anchoring means preferably includes barbs on the outer face of the duct so as to make it possible to anchor the duct in the hole in the sole so as to secure said parts permanently, the barbs pointing towards the opening of the duct so as to facilitate the insertion of the duct into the hole and prevent said duct from then being removed.

In one embodiment of the invention, the inner wall of the hole in the sole includes barbs which point towards the bottom of the hole and which cooperate with barbs on the outer part of the duct for anchoring the duct to the sole and preventing said duct from then being removed.

In another embodiment of the invention, the anchoring means includes a flexible system at the end of the duct situated in the vicinity of the closed part, the flexible system comprising a plurality of elements with a pointed shape for allowing the duct to be anchored in the hole in the sole so as to secure said parts permanently, the pointed flexible elements being suitable for being depressed towards the interior of the duct and facilitating insertion thereof into the hole, and for extending out towards the outside of the duct so as to be wedged in the sole and remain blocked there.

In one embodiment of the invention, the anchoring means comprises glue for reinforcing the permanent fixing of the duct and the sole.

In another embodiment of the invention, the cover preferably comprises flexible toric lamellae on the outer face suitable for cooperating with the duct, the inner face of the duct being smooth, so as to hold the cover on the duct and ensure the tightness of the casing.

In another embodiment of the invention, the cover comprises a first fixing part and the duct comprises a second fixing part, the first and second fixing parts being arranged so as to cooperate together, the first fixing part including a first screw thread on the outer face of the cover and the second fixing part including a second screw thread disposed on the inner face on the duct in the vicinity of the opening, so as to make it possible to hold the cover on the duct and assure the tightness of the casing.

In another embodiment of the invention, the cover preferably includes a lever-based closing system suitable for cooperating with a duct, the inner face of said duct being smooth, the closing system comprising a lever suitable for acting by compression on a toric joint and a blocking piece in contact with the opening of the duct and making it possible to block the cover on the duct in a leak-tight manner.

In another embodiment of the invention, the cover preferably comprises a bayonet-based closing system comprising two tabs, and the duct including grooves suitable for cooperating with the two tabs, the two tabs being blocked in the grooves by rotating the cover so as to allow a robust fixing between the cover and the duct and so as to make the casing leak-tight.

In another embodiment of the invention, the cover comprises a first fixing part and the duct comprises a second fixing part, the first and second fixing parts being arranged so as to cooperate together, the first fixing part including a first screw thread on the inner face of the cover and the second fixing part including a second screw thread disposed on the outer face on the duct in the vicinity of the opening, so as to make it possible to hold the cover on the duct and assure the tightness of the casing.

In one embodiment of the invention, the duct is slightly longer than the hole in the sole and protrudes slightly beyond the exterior of the sole so as to allow the cover with the first inner screw thread to be screwed onto the duct with the second outer screw thread.

In another embodiment of the invention, the cover comprises a rim with the first screw thread on the inner face of the cover, the diameter of the hole in the sole being slightly larger than the outer diameter at the opening of the duct so as to accommodate the cover during the screwing onto the second screw thread disposed in the outer face on the duct.

In another embodiment of the invention, the cover comprises a means for turning the cover relative to the sole, the means for turning the cover comprising a slot provided for insertion of a screwdriver or a coin so as to facilitate the screwing and unscrewing of the cover.

In a preferred embodiment of the invention, the duct is elongate and cylindrical, the hole in the sole also being of a corresponding cylindrical shape, as does also the cover.

In another embodiment of the invention, the duct is elongate and of oval cross section, the hole in the sole also having a corresponding oval cross section, as does also the cover.

In another embodiment of the invention, the duct is elongate and of rectangular cross section, the hole in the sole also having a corresponding rectangular cross section, as does also the cover.

In another embodiment of the invention, the duct is elongate and of octagonal cross section, the hole in the sole also having a corresponding octagonal cross section, as does also the cover.

In accordance with a second aspect, the invention proposes a method for producing a footwear item with a device for storing information or an object, the method comprising the following steps:

providing a footwear item comprising a sole comprising a front part and a rear part, forming a hole that opens onto the front part or the rear part of the footwear item, providing a casing comprising a duct making it possible to store information or an object, the duct including an opening and a closed part, and a cover hermetically closing the opening of the duct so as to make the casing leak-tight, the casing being of a size suitable for insertion in the hole, inserting the duct into the hole and fixing the duct to the sole by a duct anchoring means suitable for securing the duct and the sole permanently, and fixing the cover on the duct.

In one embodiment of the invention, the production method preferably comprises the steps of fixing the cover on the duct and then inserting the casing into the hole such that the cover closes the duct and the mouth of the hole.

In accordance with another aspect, the invention proposes a footwear item comprising a sole, the sole comprising a rear part, characterised in that the rear part of the sole includes a hole with a level or slanted bottom, following the shape of the sole and opening towards the rear of the footwear item, and in that the footwear item comprises a duct inserted into the hole in the sole, the duct storing information or objects.

It is also possible to provide other variants and to have soles including a hole at the front of the footwear item, opening towards the front of the footwear item, or a hole on the outer side of the rear part and opening towards the outside of the footwear item.

It is also possible to form this hole on the outside of the footwear item, extending across, with said hole opening towards the outside of the footwear item, in the rear part of the footwear item. The hole extends beyond the footwear item.

The hole can be formed in the rear of the sole, increasing the height of the rear of sole in the form of a beading as far as the base of the heel cup, or by increasing the length of the sole. The hole can also be formed in the support by increasing the volume of the neck of the support.

Within the scope of the present invention, a footwear item "sole" is a part of the footwear item intended to be situated between the foot of the user of the footwear item and the ground.

BRIEF DESCRIPTION OF THE FIGURES

Further features and advantages of the invention will become clear from reading the following detailed description. Also, in order to provide a clearer understanding of the invention, several preferred embodiments will be described hereinafter by way of example, with reference in particular to the accompanying figures, in which.

EMBODIMENT OF THE INVENTION

Figure 1:
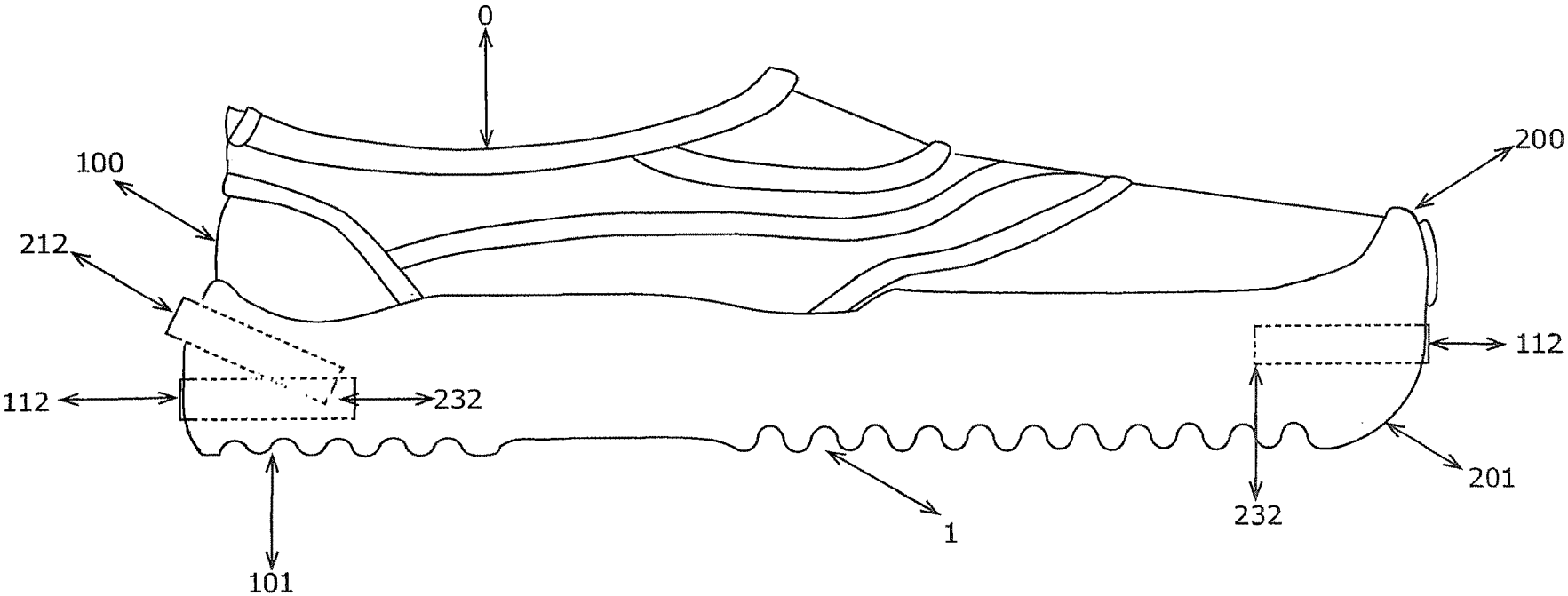
FIG. 1 shows a footwear item in one embodiment of the invention.
Figure 2:
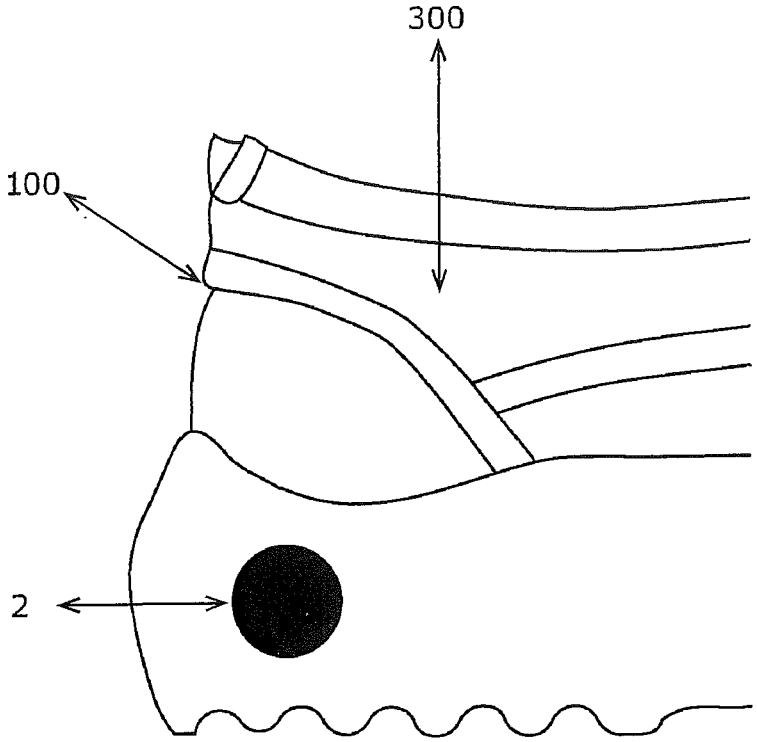
FIG. 2 shows a side view of a rear part of a footwear item in one embodiment of the invention.
Figure 3:
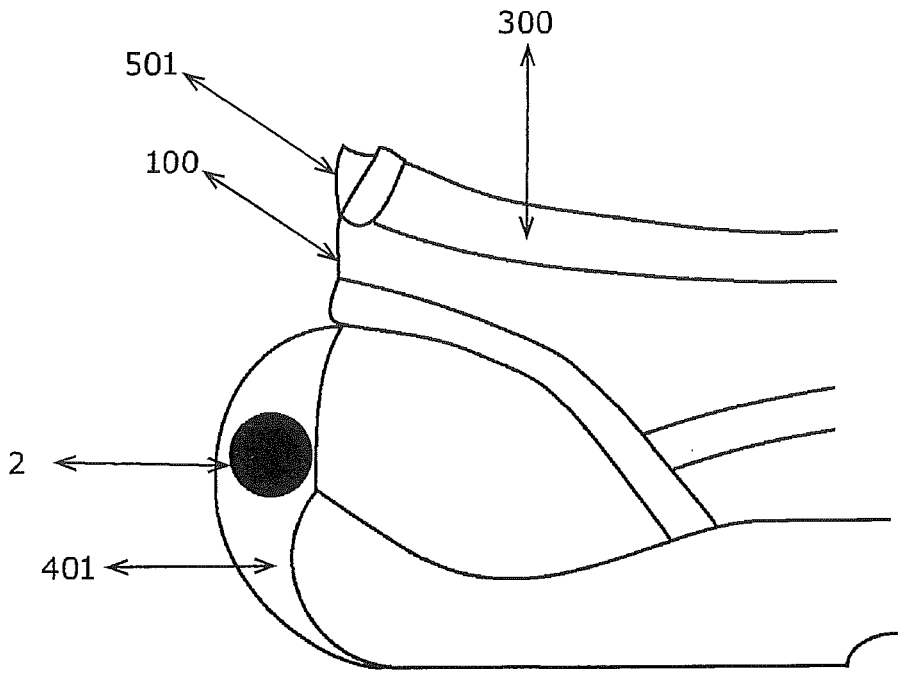
FIG. 3 shows a side view of a rear part of a footwear item in one embodiment of the invention.
Figure 4:
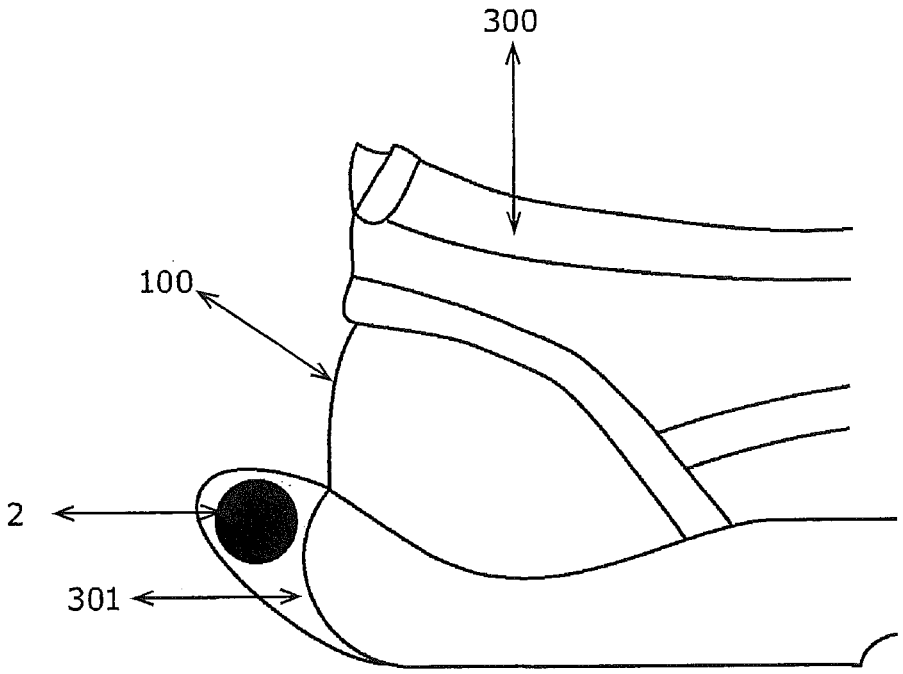
FIG. 4 shows a side view of a rear part of a footwear item in one embodiment of the invention.
Figure 5:
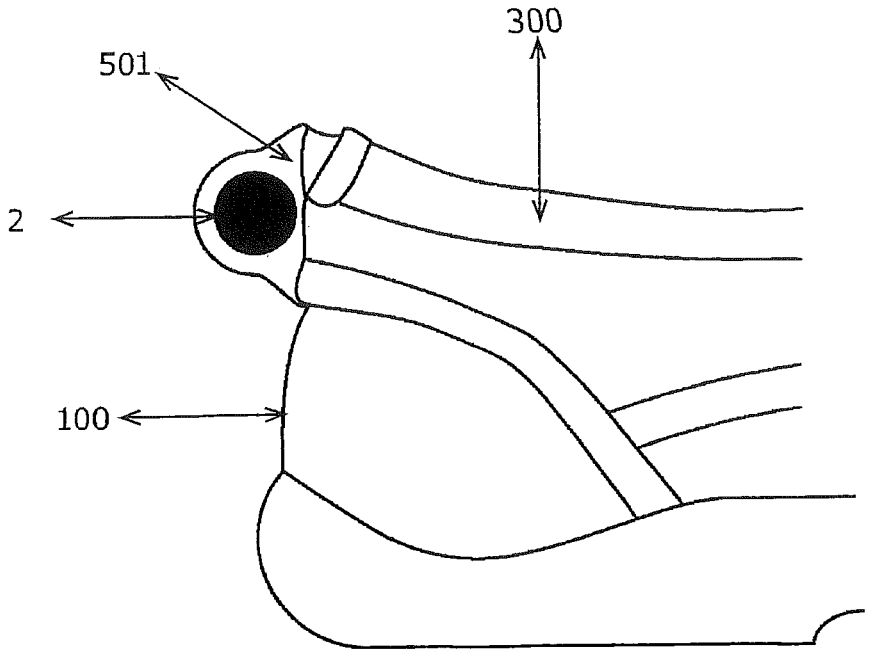
FIG. 5 shows a side view of a rear part of a footwear item in one embodiment of the invention.
Figure 6:
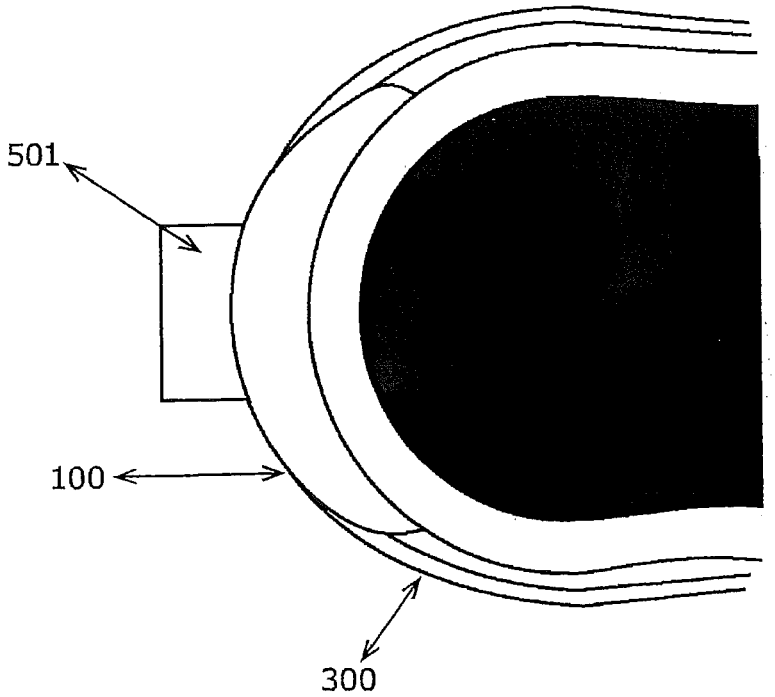
FIG. 6 shows a plan view of a rear part of a footwear item in one embodiment of the invention.

The present invention is described on the basis of particular embodiments and with reference to the figures, however the invention is not limited thereto. The drawings or figures described are merely schematic and are not limiting. FIG. 1 shows a footwear item (0) in one embodiment of the invention.

The footwear item (0) comprises a sole (1), the rear part (101) of which is visible in FIG. 1. The rear part (101) of the sole is intended to support the heel of a user of the footwear item. The rear part (101) of the sole preferably comprises a heel. The sole (1) also comprises a front part (201), which is intended to support in particular the toes of a user. The rear part (101) of the sole (1) is preferably thicker than the front part (201) of the sole.

The rear part (101) of the sole (1) comprises a hole (2) which opens towards the rear of the footwear item (0). The hole (2) is preferably situated in the heel of the footwear item (0).

Figure 7:
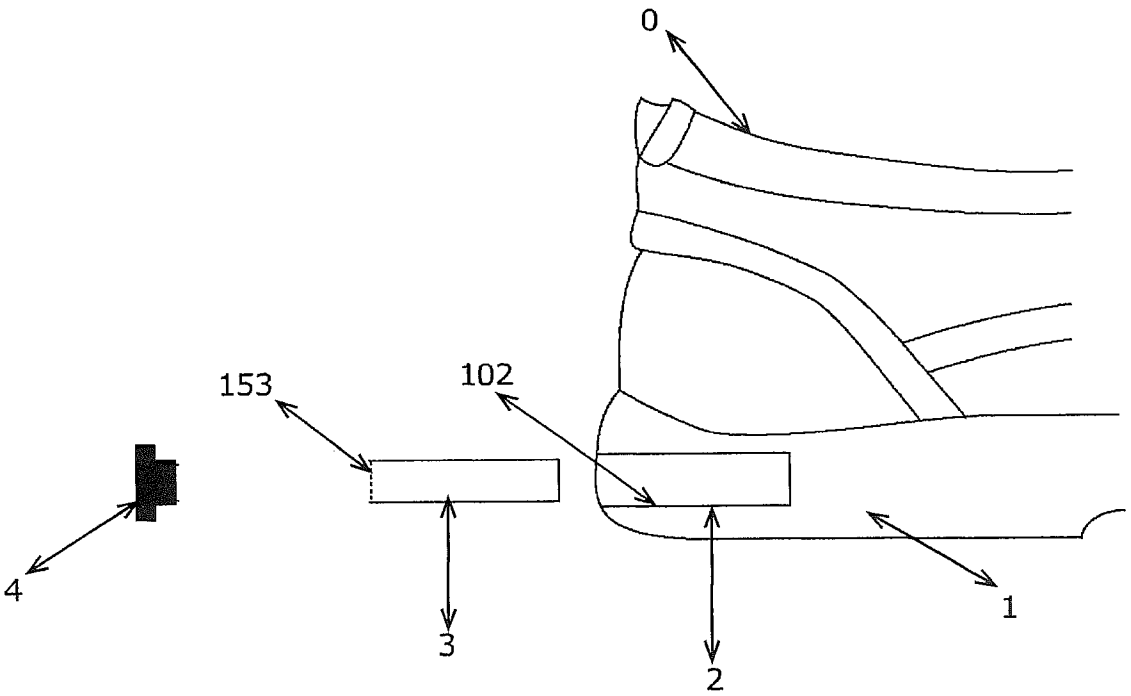
FIG. 7 shows a side view of a rear part of a footwear item in one embodiment of the invention.

As can be seen in FIG. 7, the footwear item (0) comprises a duct (3) which can be inserted manually into the hole (2). The duct (3) also comprises a cover (4) closing the opening (153) of the duct (3). The duct (3) and the cover (4) together form a leak-tight casing (3, 4).

The casing (3 and 4) has a first face, turned towards the mouth (153) of the hole when the casing is in place inside the hole (2), and a second face, opposite the first face, for closing the casing.

The casing (3 and 4) is preferably cylindrical, in which case the casing preferably has a diameter between 0.5 and 2.0 cm, more preferably between 1.0 and 1.5 cm.

The casing (3 and 4) preferably has a length between 1.0 and 10.0 cm, more preferably between 3.0 and 7.0 cm, even more preferably between 4.0 and 6.0 cm.

The hole (2) is preferably substantially parallel to the inner side of the sole and the duct (3) is preferably also installed so as to be substantially parallel to the inner side of the sole, such that the casing (3 and 4) points towards the rear in a substantially horizontal direction when the footwear item is placed flat on the ground.

The footwear item (0) can be a footwear item with a flat heel, with a heel, with a high heel, or with additional soles.

FIGS. 7 to 11 show a cover (4) intended to close the mouth (153) of the hole, moreover in an entirely leak-tight manner, so as to prevent water or dirt from entering the duct (3).

The cover (4) has a first face, turned towards the rear when the cover (4) is in place over the mouth (153) of the hole, and a second face, opposite the first face, and thus facing the first face of the casing when the cover (4) closes the hole in which the casing is inserted. The first face and the second face of the cover (4) are separated by a length of the cover.

Technical Description of the Duct, and Fixing Thereof:

As can be seen in FIG. 7, the duct (3) also comprises a cover (4) closing the opening of the duct (153) so as to form a leak-tight casing. The cover (4) is designed to close the opening in a leak-tight manner.

The duct (3) can be provided in different shapes: cylindrical (123), oval (223), rectangular (323), octagonal (423), and can be provided in different sizes.

Figures 8, 9, 10, 11:
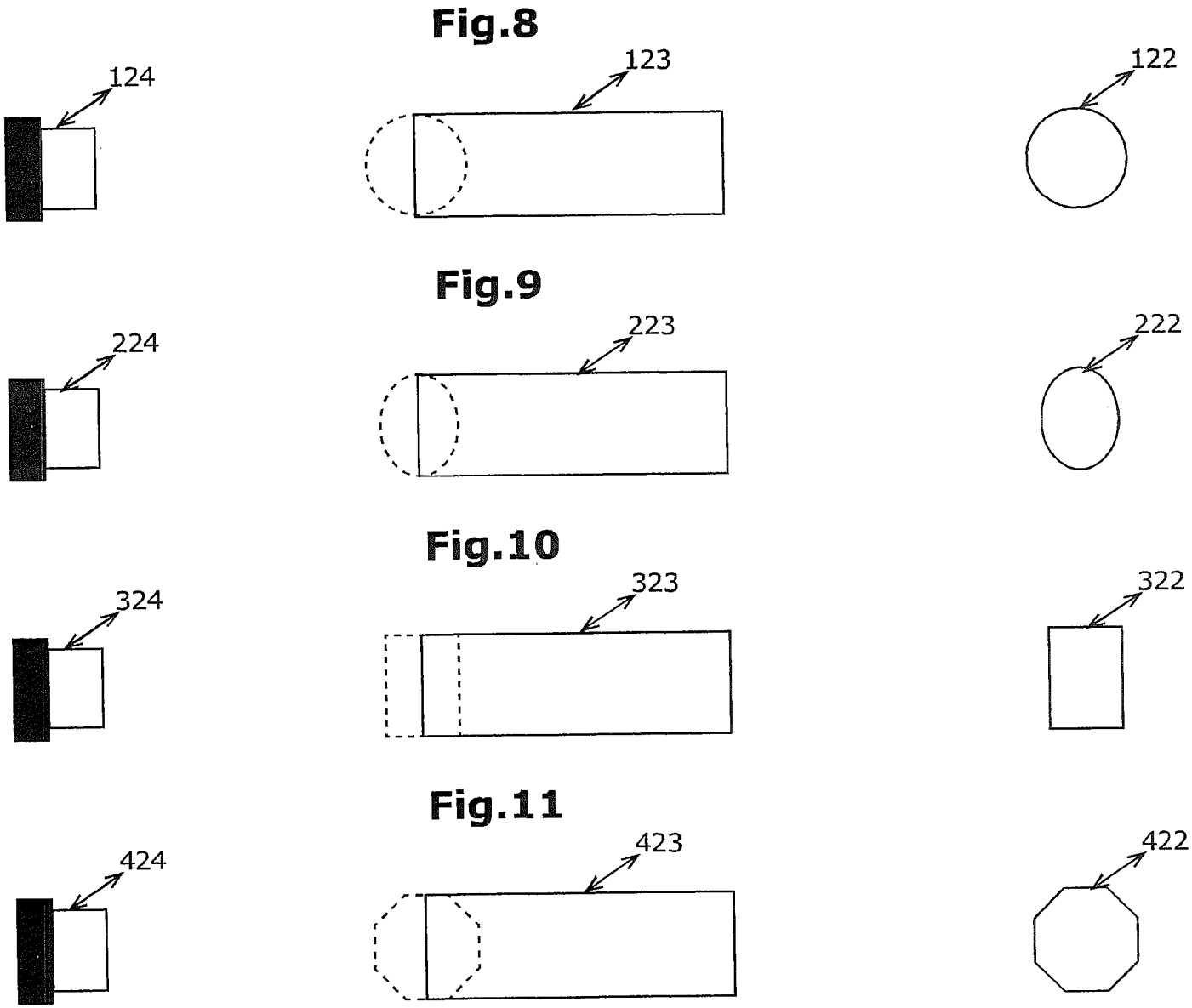
FIG. 8 shows a side view of a duct and a cover in one embodiment of the invention.
FIG. 9 shows a side view of a duct and a cover in one embodiment of the invention.
FIG. 10 shows a side view of a duct and a cover in one embodiment of the invention.
FIG. 11 shows a side view of a duct and a cover in one embodiment of the invention.

As shown in FIG. 8, if the duct (3) is elongate and cylindrical in shape (123), the hole (2) in the sole (1) will also be of a corresponding cylindrical shape (122), as will also the cover (124). In accordance with one embodiment of the invention (not shown), the duct (3) is conical in shape, and the hole (2) in the sole (1) will also be of a corresponding conical (122) shape.

As shown in FIG. 9, if the duct (3) is elongate and oval in cross section (223), the hole (2) in the sole (1) will also be of a corresponding cylindrical cross section (222), as will also the cover (224).

As shown in FIG. 10, if the duct (3) is elongate and rectangular in cross section (323), the hole (2) in the sole (1) will also be of a corresponding rectangular cross section (322), as will also the cover (324).

As shown in FIG. 11, if the duct (3) is elongate and octagonal in cross section (423), the hole (2) in the sole (1) will also be of a corresponding octagonal cross section (422), as will also the cover (424).

The duct (3) and also the cover (4) can be made on the basis of any sort of impermeable (metal, aluminium, stainless steel, any sort of plastic, carbon, rubber).

The duct (3) is preferably smooth on the inner face (143) so as to allow the objects to be easily inserted and removed.

The duct (3) is fixed permanently in the sole (1) of the footwear item by anchoring means.

Figure 12:
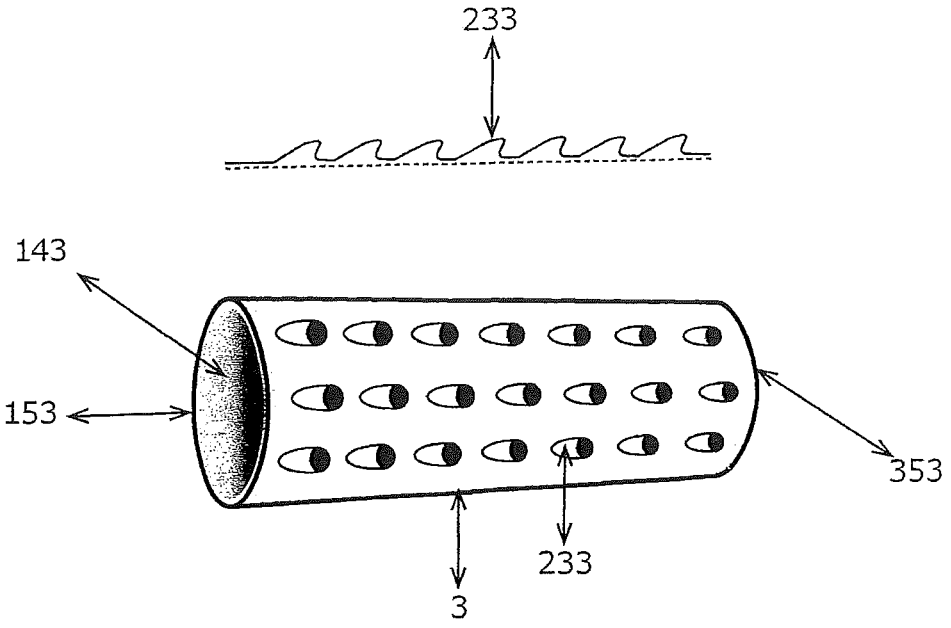
FIG. 12 shows a side view of a duct in one embodiment of the invention.

In accordance with a preferred embodiment of the invention shown in FIG. 12, the outer face of the duct comprises bumps (233) so as to form a means for anchoring the duct (3) in the hole (112, 212) of the sole (1) and so as to make it possible to fix the duct (3) to the sole (1) so as to secure them permanently. These bumps (233) of half-moon shape are open towards the opening of the duct (153) and solid towards the closed part of the duct (353). When the duct (3) is inserted into the hole (2), said duct slides easily as far as the bottom of the hole.

The bumps (233) then block the duct (3) in the hole (2) and prevent it from being removed, such that the duct (3) is permanently joined to the sole (2).

In accordance with the embodiment shown in FIG. 12, the hold of the duct (3) in the hole (2) of the sole (1) can be further reinforced advantageously by glue. The duct (3) can be fixed, for example to the sole (1), by another adhesive fixing means, cement, soldering, or by other fusing techniques.

Figure 13:
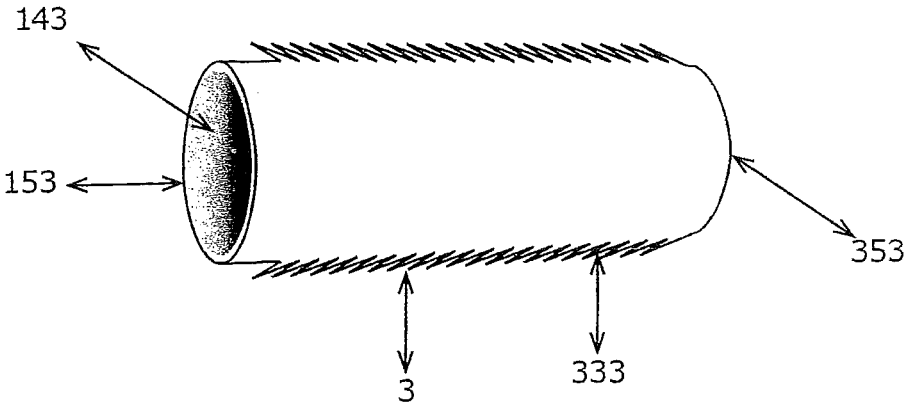
FIG. 13 shows a side view of a duct and a cover in one embodiment of the invention.
Figure 14:
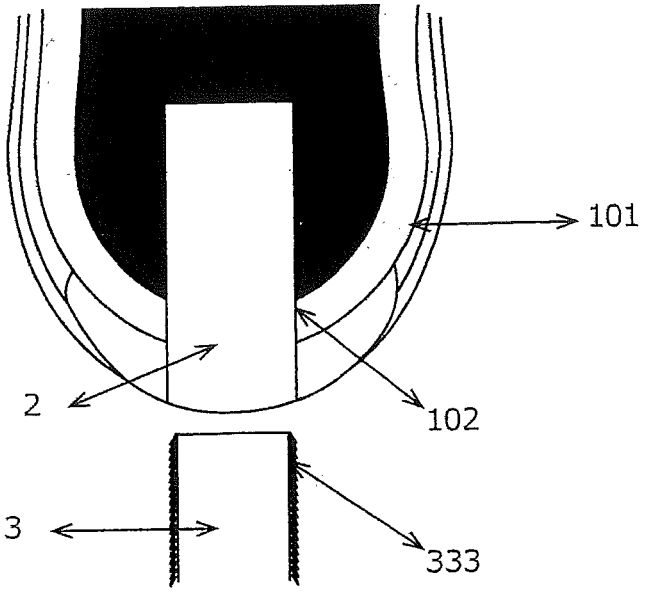
FIG. 14 shows a schematic view of a rear part of a footwear item in one embodiment of the invention.
Figure 15:
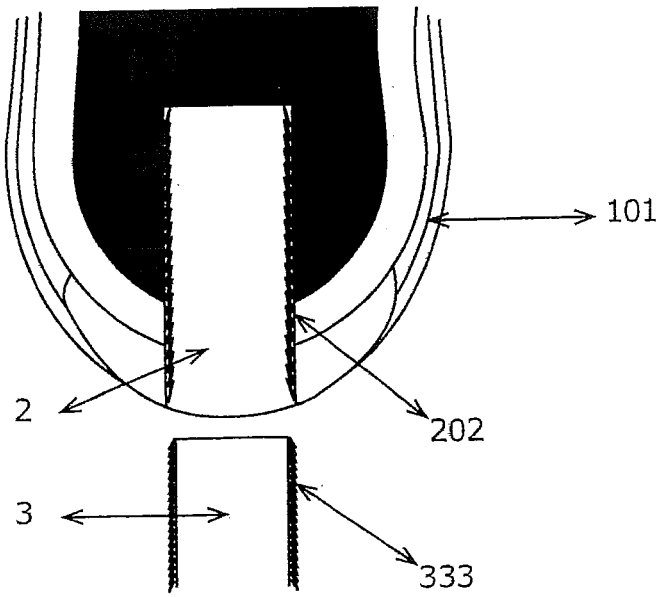
FIG. 15 shows a schematic view of a rear part of a footwear item in one embodiment of the invention.

In accordance with another preferred embodiment of the invention shown in FIGS. 13 to 15, the outer face of the duct comprises barbs (fins) (333) so as to form a means for anchoring the duct (3) in the hole (112, 212) of the sole (1) and so as to make it possible to fix the duct (3) to the sole (1) so as to secure them permanently. These barbs (333) are suitable for preventing the duct (3) from being removed from the hole (2) after having been inserted thereinto.

As can be seen in FIG. 14, the inner wall (102) of the hole (2) in the sole can be smooth, and only the outer part of the duct (3) contains barbs (333).

As can be seen in FIG. 15, in accordance with another embodiment, the inner wall (202) of the hole (2) contains the same barbs (202), which cooperate with barbs (333) on the outer part of the duct (3) so as to anchor and fix the duct (3) to the sole (1) and so as to secure them permanently.

Figure 16:
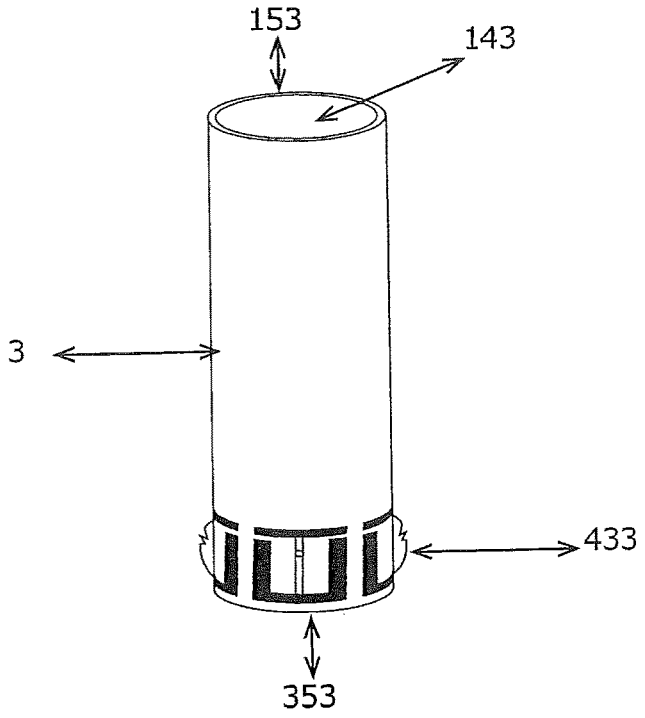
FIG. 16 shows a side view of a duct in one embodiment of the invention.

In accordance with the embodiment shown in FIGS. 14-16, the hold in the hole (2) of the sole (1) can be further reinforced advantageously by glue.

In accordance with another preferred embodiment of the invention shown in FIG. 16, the duct (3) comprises, at the end situated in the vicinity of the bottom of the hole (232), a flexible system formed of a plurality of elements of pointed shape (433), preferably four elements (433). As the duct is inserted into the hole (2), the pointed elements (433), which are flexible, can be depressed inwardly so as to facilitate the insertion thereof into the hole (2). By then inserting a cylinder (not shown) into the duct (3), during the manufacture of the footwear item, the various pointed elements (433) extend outwardly and are wedged in the sole (1) so as to remain blocked there and thus fix the duct (3) to the sole (1), these parts being secured permanently.

In accordance with the embodiment shown in FIG. 16, the hold in the hole (2) of the sole (1) can be further reinforced advantageously by glue.

The anchoring means of the duct (3) in the presented embodiments can be combined with one another.

The hold in the hole of the sole (1) as further reinforced by glue.

Figure 17:
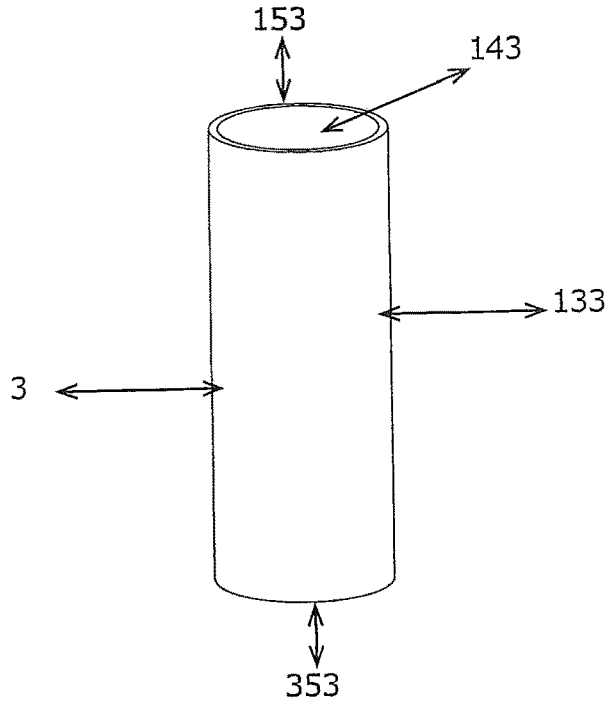
FIG. 17 shows a side view of a duct in one embodiment of the invention.

In accordance with another preferred embodiment of the invention shown in FIG. 17, the duct is smooth (133) and is fixed in the hole (2) of the sole (1) thanks to the glue. The duct (3) and the sole (1) are secured permanently solely by glue.

Description and Fixing of the Cover to the Duct:

FIGS. 18 to 27 show the cover (4) hermetically closing the mouth of the duct (3) so as to allow robust fixing between the cover (4) and the duct (3) and so as to make the casing leak-tight.

The cover (4) preferably comprises a first fixing part, and the duct (3) comprises a second fixing part, the first and second fixing parts being arranged so as to cooperate together. This makes it possible to obtain a robust and leak-tight fixing between the cover (4) and the duct (3).

Figure 18:
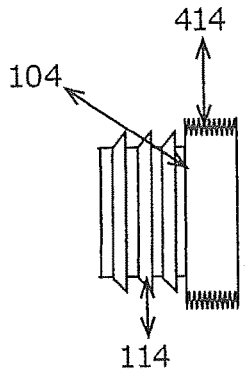
FIG. 18 shows a side view of a cover in one embodiment of the invention.

In a preferred embodiment of the invention shown in FIG. 18, the cover (4) comprises flexible toric lamellae (114) on the outer face, suitable for cooperating with a duct (3), the inner face of said duct (3) being smooth (143). The cover (4)

comprises flexible toric lamellae (114) on the outer face. By inserting the cover (4) into the duct (3) until the opening of the duct (153) contacts the base of the cover (104), the lamellae (114) can be folded slightly, thus creating a resistance which makes removal of the cover (4) difficult for a child whilst ensuring the tightness of the casing.

In order to remove the cover (4), it is suffice for the person to pull strongly on it by means of a grip (414) situated on the base of the cover (104).

Figure 21:
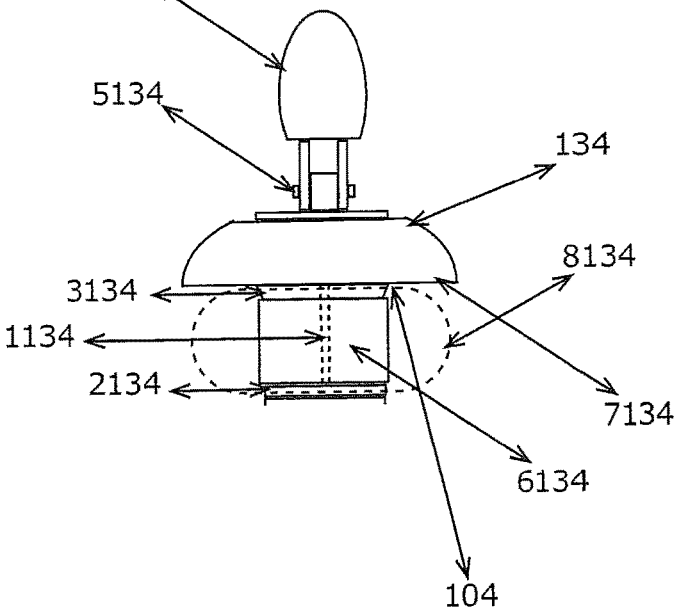
FIG. 21 shows a side view of a cover in one embodiment of the invention.

In a preferred embodiment of the invention shown in FIG. 21, the cover (4) is formed by a lever-based closing system (134), suitable for cooperating with a duct (3), the inner face of said duct being smooth (143).

This system (134) comprises a pin (1134) connected between a plate (2134), at the lower base (3134), and a lever (4134), at the head of the rod (5134). An O-ring (6134) made of rubber and a blocking piece (7134) in contact with the opening of the duct (153) are positioned between these two parts. When the closing system (134) is in contact with the opening of the duct (153) and therefore the body of the part (8134) is introduced into the duct (3), by pivoting the lever (4134) through 90 degrees relative to the duct 93), the pad (2134) approaches the blocking piece (7134) and thus compresses the rubber O-ring (6134). The diameter of said O-ring increases and thus tightly blocks the lever-based closing system (134) in the duct (3).

Figure 19:
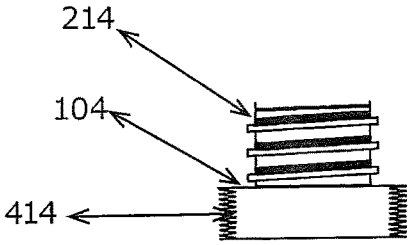
FIG. 19 shows a side view of a cover in one embodiment of the invention.
Figure 20:
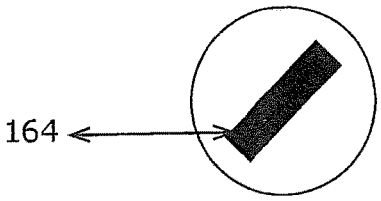
FIG. 20 shows a plan view of a cover in one embodiment of the invention.
Figure 22:
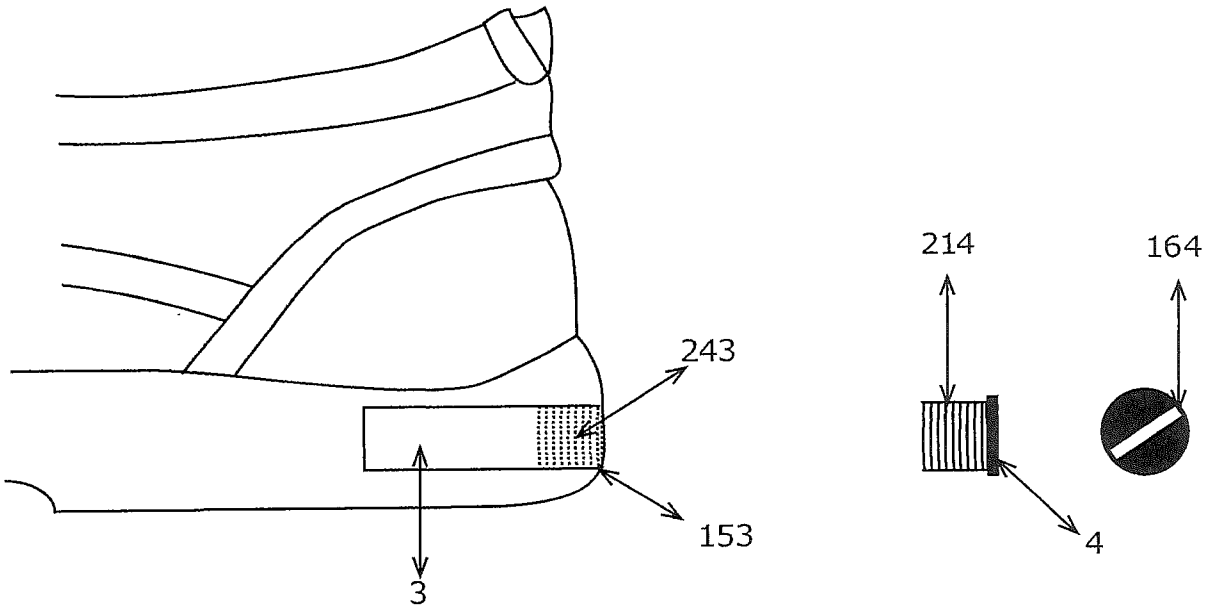
FIG. 22 shows a side view of a rear part of a footwear item, a duct and a cover in one embodiment of the invention.

In a preferred embodiment of the invention, shown in FIGS. 19, 20 and 22, the cover (4) comprises a first screw thread on the outer face (214) and the duct (3) comprises a second screw thread on the inner face around the mouth (243) of the duct, so as to correspond to the first screw thread when the cover (4) closes the opening of the duct (153).

The first screw thread (214) screws into the second screw thread (243) when the cover (4) is screwed to the opening (243) and this screwing makes it possible to obtain a leak-tight fixing, which is easy to open for an adult but is relatively difficult to open for a child.

The cover (4) preferably comprises a means (164) for turning the cover (4) relative to the sole (1). This makes the screwing and unscrewing easier. The means (164) for turning the cover relative to the sole comprises a slot (164) intended for the insertion of a coin or a screwdriver.

Figure 23:
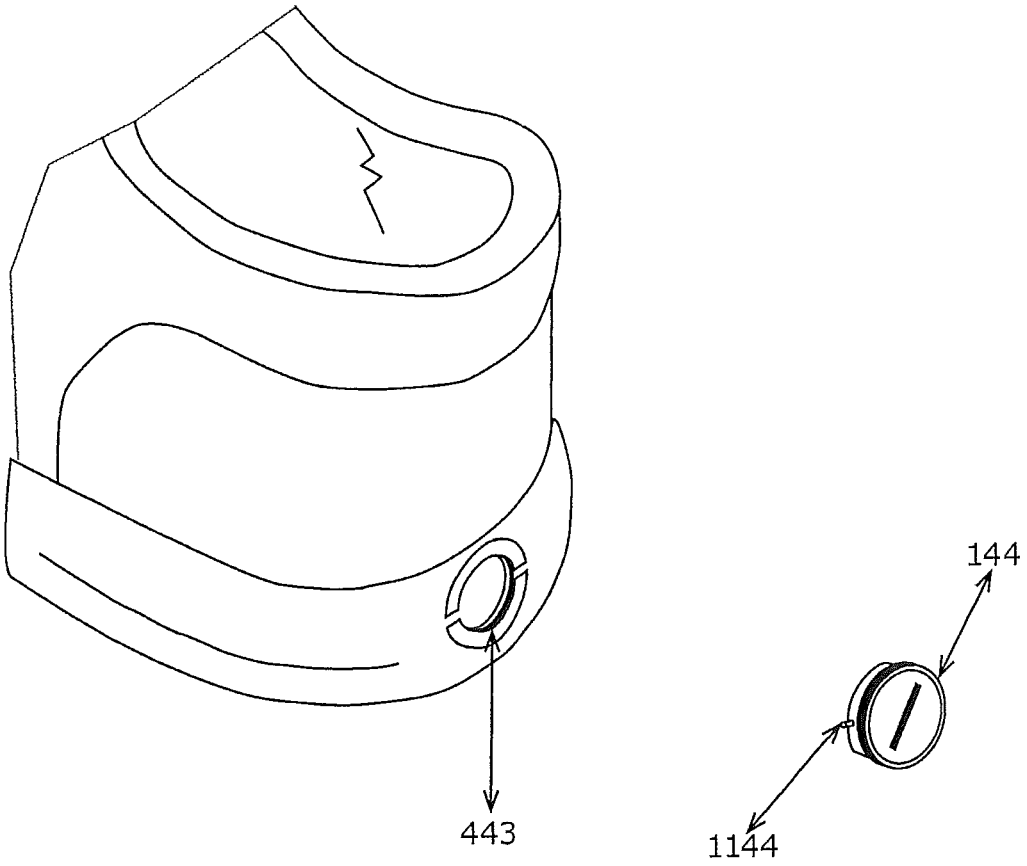
FIG. 23 shows a side view of a rear part of a footwear item, a duct and a cover in one embodiment of the invention.

In a preferred embodiment of the invention shown in FIG. 23, the fixing comprises a bayonet-based closing system (144). The end of the duct (3) contains grooves (443). The cover comprises two lugs (1144). By coupling the duct and the cover (4) with bayonet-based closing system (144), the two lugs (1144) are in contact with the grooves (443). By pivoting the cover, the two lugs (1144) are blocked in the grooves (443) so as to allow robust fixing between the cover (4) and the duct (3) and for making the casing leak-tight.

The cover (4), in accordance with the embodiment shown in FIG. 23, preferably comprises a means for turning the cover (4) relative to the sole (1). This makes the screwing and unscrewing easier. The means for turning the cover relative to the sole comprises a slot intended for the insertion of a coin or a screwdriver (164).

Figure 24:
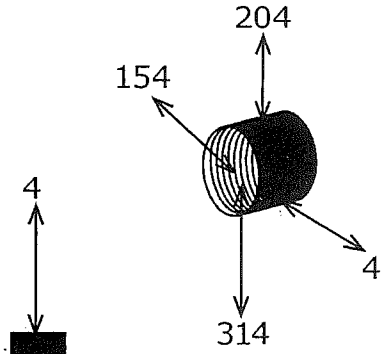
FIG. 24 shows a side view of a cover in one embodiment of the invention.
Figure 25:
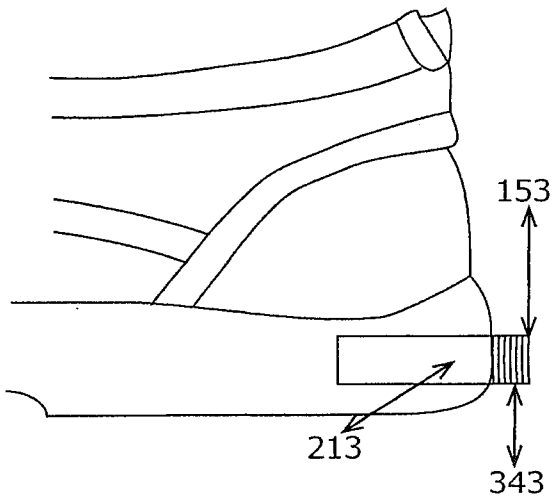
FIG. 25 shows a side view of a rear part of a footwear item, a duct and a cover in one embodiment of the invention.

In a preferred embodiment of the invention shown in FIGS. 24 and 25, the cover comprises a rim (204) with a first screw thread on the inner face (314), and the duct (213) comprises a second screw thread disposed around the opening on the outer face (343), so as to correspond to the first screw thread when the cover (4) closes the opening of the duct (153), with the duct being slightly longer than the hole in the sole and protruding slightly beyond the outside of the sole (213).

This screwing makes it possible to obtain a robust and leak-tight fixing, which is easy to open for an adult, but relatively difficult to open for a child.

The cover (4), in accordance with the embodiment shown in FIG. 25, preferably comprises a means for turning the cover (4) relative to the sole (1). This makes the screwing and unscrewing easier. The means for turning the cover relative to the sole comprises a slot (164) intended for the insertion of a coin or a screwdriver.

Figure 26:
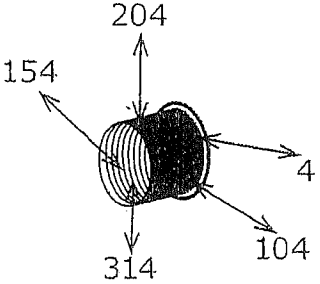
FIG. 26 shows a side view of a cover in one embodiment of the invention.
Figure 28:
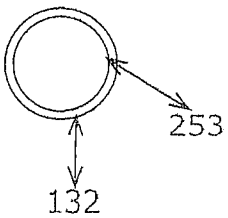
FIG. 28 shows a plan view of a cover in one embodiment of the invention.
Figure 27:
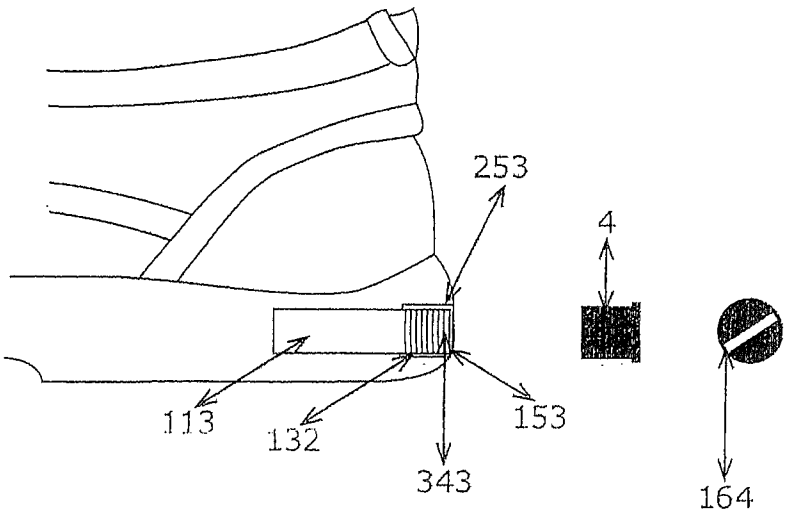
FIG. 27 shows a side view of a rear part of a footwear item, a duct and a cover in one embodiment of the invention.

In a preferred embodiment of the invention shown in FIGS. 26-28, the duct (3) is fully inserted into the sole (113). At the opening of the duct (153), the diameter of the hole (132) in the sole is slightly larger than the outer diameter (253) of the hole of the duct so as to accommodate the cover (4) during the screwing.

The cover (4) comprises a rim (204) with a first screw thread on the inner face of the cover (314), and the duct (113) comprises a second screw thread disposed around the mouth of the duct on the outer face (343), so as to correspond to the first screw thread when the cover closes the opening of the duct (153).

This screwing makes it possible to obtain a robust and leak-tight fixing, which is easy to open for an adult, but relatively difficult to open for a child.

The cover (4), in accordance with the embodiment shown in FIG. 27, preferably comprises a means (164) for turning the cover (4) relative to the sole (1). This makes the screwing and unscrewing easier. The means (164) for turning the cover relative to the sole comprises a slot intended for the insertion of a coin or a screwdriver.

The base of the cover (104) which contains the slot advantageously has a diameter of 3 mm larger than that of the body of the cover.

When the cover (4) is screwed to the duct (3), the base of the cover (104) is in contact with the sole (1) and thus prevents any dirt or liquid from penetrating between the sole (1) and the duct (3).

Summary

| Part | Specification | Reference | FIG. (S) |
|---|---|---|---|
| Footwear item: | | 0 | 1, 7 |
| | rear of the footwear item | 100 | 1, 2, 3, 4, 5, 6 |
| | front of the footwear item | 200 | 1 |
| | outer side of the footwear item | 300 | 2, 3, 4, 5, 6 |
| Sole base: | | 1 | 1.7 |
| | rear part | 101 | 1, 14, 15 |
| | front part | 201 | 1 |
| | tail of the sole | 301 | 4 |
| | tail of the sole in the form of a beading | 401 | 3 |
| | heel cup of the footwear item anterior part | 501 | 3, 5, 6 |
| Hole: | | 2 | 2, 3, 4, 5, 7, 14, 15 |
| | smooth | 102 | 7.14 |
| | barbs | 202 | 15 |
| | horizontal | 112 | 1 |
| | slanted | 212 | 1 |
| | round | 122 | 8 |
| | oval | 222 | 9 |
| | rectangular | 322 | 10 |
| | octagonal | 422 | 11 |
| | hole diameter larger than opening | 132 | 27.28 |
| | hole bottom | 232 | 1 |

-continued

Summary

| Part | Specification | Reference | FIG. (S) |
|---|---|---|---|
| Duct: | | 3 | 7, 12, 13, 14, 15, 16, 17, 22 |
| | fully inserted | 113 | 27 |
| | slightly outside the sole | 213 | 25 |
| | round | 123 | 8 |
| | oval | 223 | 9 |
| | rectangular | 323 | 10 |
| | octagonal | 423 | 11 |
| | outer finish of the duct | | |
| | smooth | 133 | 17 |
| | bumps | 233 | 12 |
| | barbs | 333 | 13, 14, 15 |
| | 4 pointed elements | 433 | 16 |
| | totally smooth interior | 143 | 12, 13, 16, 17 |
| | interior with screw thread at the end | 243 | 22 |
| | screw thread externally at the end | 343 | 25.27 |
| | groove end | 443 | 23 |
| | duct opening | 153 | 7, 12, 13, 16, 17, 22, 25, 27 |
| | duct diameter | 253 | 27.28 |
| | obstructed part of the duct | 353 | 12, 13, 16, 17 |
| Cover: | | 4 | 7, 22, 24, 25, 26, 27 |
| | base of the cover | 104 | 18, 19, 21, 26 |
| | rim of the cover | 204 | 24.26 |
| | toric lamellae | 114 | 18 |
| | outer screw thread | 214 | 19.22 |
| | inner screw thread | 314 | 24.26 |
| | cover grip | 414 | 18.19 |
| | round | 124 | 8 |
| | oval | 224 | 9 |
| | rectangular | 324 | 10 |
| | octagonal | 424 | 11 |
| | lever-based closing system | 134 | 21 |
| | pin | 1134 | 21 |
| | pad | 2134 | 21 |
| | lower base | 3134 | 21 |
| | lever | 4134 | 21 |
| | bar head | 5134 | 21 |
| | toric joint | 6134 | 21 |
| | blocking part | 7134 | 21 |
| | body of the part | 8134 | 21 |
| | bayonet-type closing system | 144 | 23 |
| | two lugs | 1144 | 23 |
| | inner face of the cover | 154 | 24.26 |
| | slot for insertion of a screwdriver | 164 | 20, 22, 27 |

The present invention is not in any way limited to the embodiment described by way of example and shown in the drawings. Numerous modifications of the details, shapes and dimensions could be made without departing from the scope of the invention. The present invention has been described with reference to specific embodiments which are purely illustrative and should not be considered limiting. The reference numbers in the claims do not limit the scope thereof.

The invention claimed is:

1. A footwear item with a device for storing information or an object, the footwear item comprising a sole (1), the sole (1) including a front portion (201) and a rear portion (101), wherein the sole (1) includes a hole (2) that opens onto the front portion (201) or the rear portion (100) of the footwear item (0), and in that the footwear item (0) comprises a casing (3, 4) inserted into the hole (2) of the sole (1), the casing (3, 4) comprising a duct (3) to store information or an object, the duct (3) including a closed portion (353) and a mouth (153) equipped with a cover (4), a means (233, 333, 433) for anchoring the duct (3) in the hole (2) in the sole (1), the anchoring means configured for fixing the duct (3) to the sole (1) and securing the duct to the sole permanently, wherein the cover (4) hermetically closes the mouth (153) of the duct (3) to make the casing (3, 4) leak-tight, and the anchoring means (233) is integrated in the duct (3) and comprises one of the following:

a) a plurality of bumps (233) on an outer face of the duct (3), each of the plurality of bumps (233) having a half-moon shape, open towards the mouth (153) of the duct (3) and solid towards the closed portion (353) of the duct (3) so as to facilitate the insertion of the duct (3) into the hole (2) and prevent the duct (3) from then being removed, or b) a plurality of barbs (333) on the outer face of the duct (3), each of the plurality of barbs (333) pointing towards the mouth (153) of the duct (3) so as to facilitate the insertion of the duct (3) into the hole (2) and prevent the duct (3) from then being removed, the plurality of bumps (233) or the plurality of barbs (333) anchoring the duct (3) in the hole (2) of the sole (1) so as to secure the duct and the sole permanently.

2. The footwear item according to claim 1, wherein an inner wall (102) of the hole (2) in the sole includes barbs (202) which point towards a bottom (232) of the hole (2) and which cooperate with barbs (333) on the outer portion of the duct (3) for anchoring the duct (3) to the sole (1) and preventing the duct (3) from then being removed.

3. The footwear item according to claim 1, wherein the anchoring means (433) is integrated in the duct (3) and includes a flexible system (433) at the end of the duct (3) situated in the vicinity of the closed portion (353), the flexible system comprising a plurality of elements with a pointed shape (433) for allowing the duct (3) to be anchored in the hole (2) in the sole (1) so as to secure the portions permanently, the pointed flexible elements (433) configured for being depressed towards the inside of the duct (3) and facilitating insertion thereof into the hole (2), and for extending out towards the outside of the duct (3) so as to be wedged in the sole (1) and remain blocked there.

4. Footwear item according to claim 1, wherein the anchoring means comprises glue for reinforcing the permanent fixing of the duct (3) and the sole (1).

5. The footwear item according to claim 1, wherein the cover (4) comprises a plurality of flexible ring-shaped gaskets (114) on the outer face configured for engaging with the duct (3), the inner face (143) of the duct being smooth so as to hold the cover (4) on the duct (3) and ensure the tightness of the casing (3, 4).

6. The footwear item according to claim 1, wherein the cover (4) comprises a first attachment portion (214) and the duct (3) comprises a second attachment portion (243), the first (214) and second (243) attachment portions being arranged so as to cooperate together, the first attachment portion including a first screw thread (214) on the outer face (214) of the cover (4) and the second attachment portion (243) including a second screw thread (243) disposed on the inner face on the duct (3) near the mouth (153), to hold the cover (4) on the duct (3) and ensure tightness of the casing (3, 4).

7. The footwear item according to claim 1, wherein the cover (4) includes a lever-based closing system (134) configured for engaging with a duct (3), the inner face of the duct (3) being smooth (143), the closing system (134) comprising a lever (4134) suitable for acting by compression on an O-ring (6134) and a blocking piece (7134) in contact with the mouth (153) of the duct (3) to block the cover (4) on the duct (3) in a leak-tight manner.

8. The footwear item according to claim 1, wherein the cover (4) comprises a bayonet-based closing system (144) including two tabs (1144), the duct (3) including grooves (443) configured for cooperating with the two tabs (1144), the two tabs (1144) being blocked in the grooves (443) by rotating the cover (4) so as to allow a robust fixing between the cover (4) and the duct (3) and so as to make the casing leak-proof.

9. The footwear item according to claim 1, wherein the cover (4) comprises a first attachment portion (314) and the duct (3) comprises a second attachment portion (343), the first (314) and second (343) attachment portions being arranged so as to cooperate together, the first attachment portion including a first screw thread (314) on the inner face (314) of the cover (4) and the second attachment portion (243) including a second screw thread (343) disposed on the outer face on the duct (3) near the mouth (343), to hold the cover (4) on the duct (3) and ensure the tightness of the casing (3, 4).

10. The footwear item according to claim 9, wherein the duct (3) is slightly longer than the hole (132) in the sole (213) and protrudes slightly beyond the outside of the sole (213) so as to allow the cover (4) with the first inner screw thread (314) to be screwed onto the duct (3) with the second outer screw thread (343).

11. The footwear item according to claim 9, wherein the cover (4) comprises a rim (204) with the first screw thread (314) on the inner face of the cover (4), the diameter of the hole (132) in the sole being slightly larger than the outer diameter (253) at the mouth of the duct (153) so as to accommodate the cover (4) during the screwing onto the second screw thread (343) disposed in the outer face on the duct (3).

12. The footwear item according to claim 1, wherein the cover (4) comprises a means (164) for turning the cover (4) relative to the sole (1), the means (164) for turning the cover (4) comprising a slot (164) provided for insertion of a screwdriver or a coin so as to facilitate the screwing and unscrewing of the cover (4).

13. The footwear item according to claim 1, wherein the duct (3) is elongate and cylindrical in shape (123), the hole (2) in the sole (1) and the cover (124) being of a corresponding cylindrical shape (122);

or the duct (3) is elongate and oval in cross section (223), the hole (2) in the sole (1) and the cover (124) being of a corresponding oval cross section (222);

or the duct (3) is elongate and rectangular in cross section (323), the hole (2) in the sole (1) and the cover (124) being of a corresponding rectangular cross section (322);

or the duct (3) is elongate and octagonal in cross section (423), the hole (2) in the sole (1) and the cover (124) being of a corresponding octagonal cross section (422).

14. A method for producing a footwear item (0) with a device for storing information or an object, the method comprising the following steps:

providing a footwear item (0) comprising a sole (1), the sole (1) comprising a front part (201) and a rear part (101), forming a hole (2) that opens onto the front part (200) or the rear part (100) of the footwear item (0), providing a casing (3, 4) comprising a duct (3) to store information or an object, the duct (3) including a closed portion (353) and a mouth (153) equipped with a cover (4) hermetically closing the mouth (153) of the duct (3) so as to make the casing (3, 4) leak-tight, the casing (3, 4) being of a size suitable for being inserted in the hole (2), inserting the duct (3) into the hole (2) and fixing the duct (3) to the sole (1) by an anchoring means integral with the duct (3), the anchoring means configured for securing the duct (3) and the sole (1) permanently, the anchoring means (233) integrated in the duct (3) including one of the following: a) a plurality of bumps (233) on the outer face of the duct (3), each of the plurality of bumps (233) being provided in a half-moon shape, open towards the mouth (153) of the duct (3) and solid towards the closed portion (353) of the duct (3) so as to facilitate the insertion of the duct (3) into the hole (2) and prevent the duct (3) from then being removed, or b) a plurality of barbs (333) on the outer face of the duct (3), each of the plurality of barbs (333) pointing towards the mouth (153) of the duct (3) so as to facilitate the insertion of the duct (3) into the hole (2) and prevent the duct (3) from then being removed, the plurality of bumps (233) or the plurality of barbs (333) anchoring the duct (3) in the hole (2) of the sole (1) so as secure the duct and the sole permanently, and fixing the cover (4) on the duct (3).

15. The method according to claim 14, further comprising the steps of:

fixing the cover (4) on the duct (3); and inserting the casing (3, 4) into the hole (2) such that the cover (4) closes the duct (3) and the mouth of the hole (3).

* * * * *